US005839318A

United States Patent [19]

Kimura et al.

[11] Patent Number: 5,839,318

[45] Date of Patent: Nov. 24, 1998

[54] COAXIAL ENGINE STARTER SYSTEM

[75] Inventors: Eiichi Kimura, Gunma-ken; Shinichi Nagashima, Tochigi-ken; Mitsuhiro Kogure, Gunma-ken; Michio Okada, Gunma-ken; Koji Nara, Gunma-ken, all of Japan

[73] Assignee: Mitsuba Corporation, Gunma-ken, Japan

[21] Appl. No.: 654,658

[22] Filed: May 29, 1996

[30] Foreign Application Priority Data

| | | | |
|---|---|---|---|
| May 29, 1995 | [JP] | Japan | 7-153814 |
| May 29, 1995 | [JP] | Japan | 7-153815 |
| May 29, 1995 | [JP] | Japan | 7-153817 |

[51] Int. Cl.[6] ..... F02N 11/00

[52] U.S. Cl. ..... 74/7 R; 74/6; 290/38 R

[58] Field of Search ..... 74/6, 7 R; 290/31, 290/36 R, 36 A, 38 R

[56] References Cited

U.S. PATENT DOCUMENTS

| | | | |
|---|---|---|---|
| 3,177,368 | 4/1965 | Seilly | 74/7 R |
| 3,232,123 | 2/1966 | Wheatley | 74/7 R |
| 3,399,576 | 9/1968 | Seilly et al. | 74/7 R |
| 4,838,100 | 6/1989 | Tanaka | 74/7 R |
| 4,862,027 | 8/1989 | Isozumi et al. | 74/7 R |
| 4,962,340 | 10/1990 | Isozumi | 74/7 R |
| 4,985,637 | 1/1991 | Isozumi | 74/7 R |
| 5,023,466 | 6/1991 | Isozumi | 74/7 R |
| 5,118,960 | 6/1992 | Sasamoto et al. | 290/48 |
| 5,196,727 | 3/1993 | Isozumi et al. | 74/7 R |
| 5,390,555 | 2/1995 | Gotou et al. | 74/7 R |
| 5,528,084 | 6/1996 | Shiga et al. | 290/38 R |

FOREIGN PATENT DOCUMENTS

| | | |
|---|---|---|
| 63-90666 | 4/1988 | Japan . |
| 1-208564 | 8/1989 | Japan . |

*Primary Examiner*—Charles A. Marmor
*Assistant Examiner*—David M. Fenstermacher
*Attorney, Agent, or Firm*—Skjerven Morrill MacPherson Franklin & Friel LLP; Thomas S. MacDonald

[57] ABSTRACT

In a coaxial engine starter comprising a pinion (6) connected to the output shaft (4) which is driven by an electric motor (3), via a helical spline (19), a switch unit (7) for selectively closing a power supply line to the electric motor, and a solenoid device (9) consisting of an annular armature and an annular energization coil surrounding the output shaft to axially drive the pinion and a moveable contact of the switch unit in the axial direction, the switch is adapted to be closed before the pinion is actuated by the solenoid device. Therefore, the output requirement for the solenoid device can be reduced as opposed to the conventional starter in which the pinion is actuated strictly by the solenoid device, and the size of the engine starter can be reduced.

17 Claims, 5 Drawing Sheets

1
2
3
4
5
6
7
8
9
10
11
12
13
14
15
16
17
18
18a
19
20
21
22
23
24
25
25a
26
27
27a
28
29
30
31
31a
32
33
34
35
36
37
40
41
43
43a
44
45
II
II

COAXIAL ENGINE STARTER SYSTEM

RELATED APPLICATIONS

This application relates to U.S. Ser. No. 08/653,873, filed May 28, 1996 and U.S. Ser. No. 08/654,065, filed May 28, 1996 by the same inventors and having a common assignee.

TECHNICAL FIELD

The present invention relates to an engine starter system, and in particular to an engine starter system having an output shaft, an electric motor, and a solenoid device all in a coaxial arrangement.

BACKGROUND OF THE INVENTION

In conventional engine starters, it has been customary to arrange an output shaft, which carries an axially slidable pinion adapted to mesh with a ring gear, and a solenoid device for axially driving the pinion, in a mutually parallel relationship. However, because such bi-axial engine starters have a solenoid device which extends radially from the electric motor, and therefore inevitably have a substantial radial dimension, there have been severe restrictions in ensuring a sufficient space for mounting the engine starter.

To overcome such a problem, in Japanese patent laid-open publications (kokai) Nos. 1-208564 and 63-90666, it was proposed to provide coaxial starters having an annular solenoid device surrounding the output shaft.

However, in an engine starter having the output shaft and the solenoid device in a coaxial relationship as disclosed in the above indicated patent publications, because the axial force produced by the magnetic flux, which is generated from an energization coil and passes through the armature, cannot be amplified by using a lever mechanism, the output of the energization coil must be increased so that the pinion may be directly actuated. Therefore, although the coaxial arrangement was designed as a means for reducing the size of the starter, the increase in the size of the energization coil more than offsets the gain in size reduction which might be achieved by the coaxial arrangement.

In such a coaxial type engine starter, the moveable contact which selectively closes and opens the power supply line to the electric motor, and a shifter for pushing out the pinion into meshing engagement with the ring gear of the engine are connected to the respective ends of the armature which moves axially inside the inner bore of the energization coil. Therefore, according to such a starter, the armature must be able to move a same distance as the pinion, and a space for movement must be reserved for the moveable contact so as not to interfere with the movement of the pinion so that there was difficulty in reducing the axial dimension of the starter.

The output shaft of an engine starter is normally made of steel. When a solenoid device is provided around the output shaft as required in a coaxial engine starter, a magnetic path is established between the solenoid device and the output shaft so that this reduces the magnitude of the magnetic flux passing through the armature which applies an axial force to the pinion, and may cause an insufficiency in the attractive force. In other words, in engine starters having the output shaft and the solenoid device in a coaxial relationship as disclosed in the aforementioned patent publications, as there is a need to provide a sufficiently large air gap between the armature and the output shaft, the energization coil tends to have a large outer diameter, and this has prevented a compact design of the engine starter of this type.

An essential requirement of an engine starter is its capability to start the engine without fail. Any considerations to reduce the size and cost of the starter motor should not in any way compromise the performance of the engine starter in starting the engine.

BRIEF SUMMARY OF THE INVENTION

In view of such problems of the prior art, a primary object of the present invention is to provide a compact coaxial engine starter in which the rotor shaft of the electric motor, the slidable shaft of the pinion, and the solenoid device for driving the pinion and the switch are arranged in a coaxial relationship.

A second object of the present invention is to provide a coaxial engine starter which allows the axial dimension of the starter to be reduced by limiting the stroke for its switch unit.

A third object of the present invention is to provide a coaxial engine starter which allows the radial dimension of the starter to be reduced by limiting the outer diameter of its energization coil.

A fourth object of the present invention is to provide a coaxial engine starter which allows the size of its energization coil to be reduced by reducing the required output thereof at the initial stage of its operation.

A fifth object of the present invention is to provide a coaxial engine starter which allows the number of component parts for its switch unit to be reduced, and the structure for the switch unit to be simplified.

A sixth object of the present invention is to provide a coaxial engine starter which can start the engine in a highly reliable manner.

According to the present invention, these and other objects can be accomplished by providing an engine starter, comprising: an electric motor, an output shaft disposed coaxially with respect to the electric motor in a power transmitting relationship; a pinion for driving a ring gear of an engine which is connected to the output shaft via spline means in a coaxial relationship; a switch unit including a fixed contact and a moveable contact for selectively closing a power supply line leading to the electric motor; and a solenoid device consisting of an annular armature and an annular energization coil surrounding the output shaft to axially drive the pinion and a moveable contact of the switch unit in the axial direction; wherein the spline means consists of a helical spline.

According to this structure, because an axial force is applied to the pinion upon starting the rotation of the electric motor by virtue of the helical spline, the pinion can be axially driven even when any substantial electric current is not supplied to the energization coil at an early stage of the operation of the starter. Therefore, the energization coil is only required to produce a magnetic flux which is sufficient to retain the pinion after it has been fully attracted to the energization coil, and, hence, can be reduced in size.

In conventional starters relying on a helical spline for pushing out the pinion, the axial force is produced only when the inertia of the pinion assembly provides a necessary reaction force. Therefore, when the pinion fails to mesh with the ring gear, for instance, by striking the side surface of the ring gear, the pinion will then start rotating freely, and the axial force to push out the pinion will be lost. However, according to the present invention, even in such a situation, the solenoid device can provide a necessary axial force to push the pinion into engagement with the ring gear. It should be noted that a solenoid device can produce a substantially greater force when the magnetic gap is about to be closed than when the magnetic gap is relatively wide. The helical drive, on the other hand, can provide a relatively large axial drive force at an early stage of its actuation, and can successfully push out the pinion even when the sliding resistance of the pinion is substantial.

When the battery is not fully charged or is otherwise incapable of generating a sufficient electric current to effectively actuate the helical drive, the limited electric current can still actuate the solenoid device, and this can improve the reliability of the engine starter in starting the engine. Thus, the present invention takes advantages of both the solenoid drive and the helical drive in axially actuating the pinion, and can substantially and conveniently improve the reliability of the engine starter.

To fully take advantage of the action of the helical spline, it is preferable to interpose lost motion means in a path of force transmission between the armature and the moveable contact of the switch unit for allowing movement of the armature after the moveable contact has come into full contact with the fixed contact. Thus, the armature is allowed to continue its movement to axially drive the pinion even after the moveable contact has come into full engagement with the fixed contact. In particular, if a gap is defined in an axial force transmitting path between the pinion and the armature, the gap being no less than a stroke of the moveable contact from a rest position thereof to a contact position thereof for establishing a contact with the fixed contact, the armature is already assisted by the axial force produced by the helical spline after starting the rotation of the electric motor when the armature starts to directly and axially drive the pinion.

To ensure the pinion from dislodging from the ring gear due to the presence of the gap, the gap should be less than one half of a meshing overlap between the pinion and the ring gear when the pinion is properly meshed with the ring gear.

According to a preferred embodiment of the present invention, the armature consists of a first path which is connected to the moveable contact and a second part which is connected to the pinion, the first and second parts being coaxially nested with each other so as to be axially moveable relative to each other. It is thus made possible to define two different strokes for the two different parts of the armature so that the actuation stroke for the moveable contact can be minimized, and the axial length of the starter can be reduced. To optimize the change in the attractive force acting upon the second part of the armature over the entire stroke of the second part of the armature, it is advantageous to provide a stopper in the first part of the armature to stop the first part upon energization of the energization coil at a position leaving a small magnetic air gap which is eventually filled by the second part of the armature. It should be noted that this feature can be incorporated in engine starters which rely on a solenoid device for pushing out the pinion substantially without any help from a helical drive. This feature by itself can increase the effective drive force of the solenoid device for engine starters, and can allow the axial dimension of the starter motor to be substantially reduced.

It may be desirable to provide engagement means between the first and second parts of the armature to transmit an axial force from the first part to the second part to assist movement of the second part toward closing the magnetic gap. Thus, the second part is not only magnetically actuated by the energization coil, assisted by the first part of the armature which reduces the effective size of the magnetic gap, but also mechanically actuated by the first part of the armature. According to this structure, the reliability of the operation of the second part of the armature can be ensured. The engagement means may comprise axial shoulders defined on the first and second parts which are adapted to abut each other when the first part is actuated into an axial movement by the energization coil, and/or spring means interposed between the first and second parts for transmitting an axial force from the first part to the second part.

In the coaxial engine starter, a substantial part of the magnetic flux generated from the energization coil passes through the output shaft when it is made of steel which is ferromagnetic, and the effective attractive force of the energization coil acting upon the armature. Therefore, it was necessary to provide an air gap around the output shaft to reduce the magnetic flux passing through the output shaft, thereby undesirably increasing the radial dimension of the engine starter. To overcome this problem, it is preferred to use an output shaft which is made of stainless steel or other non-magnetic material.

BRIEF DESCRIPTION OF THE DRAWINGS

Now the present invention is described in the following with reference to the appended drawings, in which:

FIG. 1 is a top half sectional view of a first embodiment of the coaxial engine starter according to the present invention showing the rest condition of the starter.

DETAILED DESCRIPTION OF THE PREFERRED EMBODIMENTS

Figures 1A, 1B:
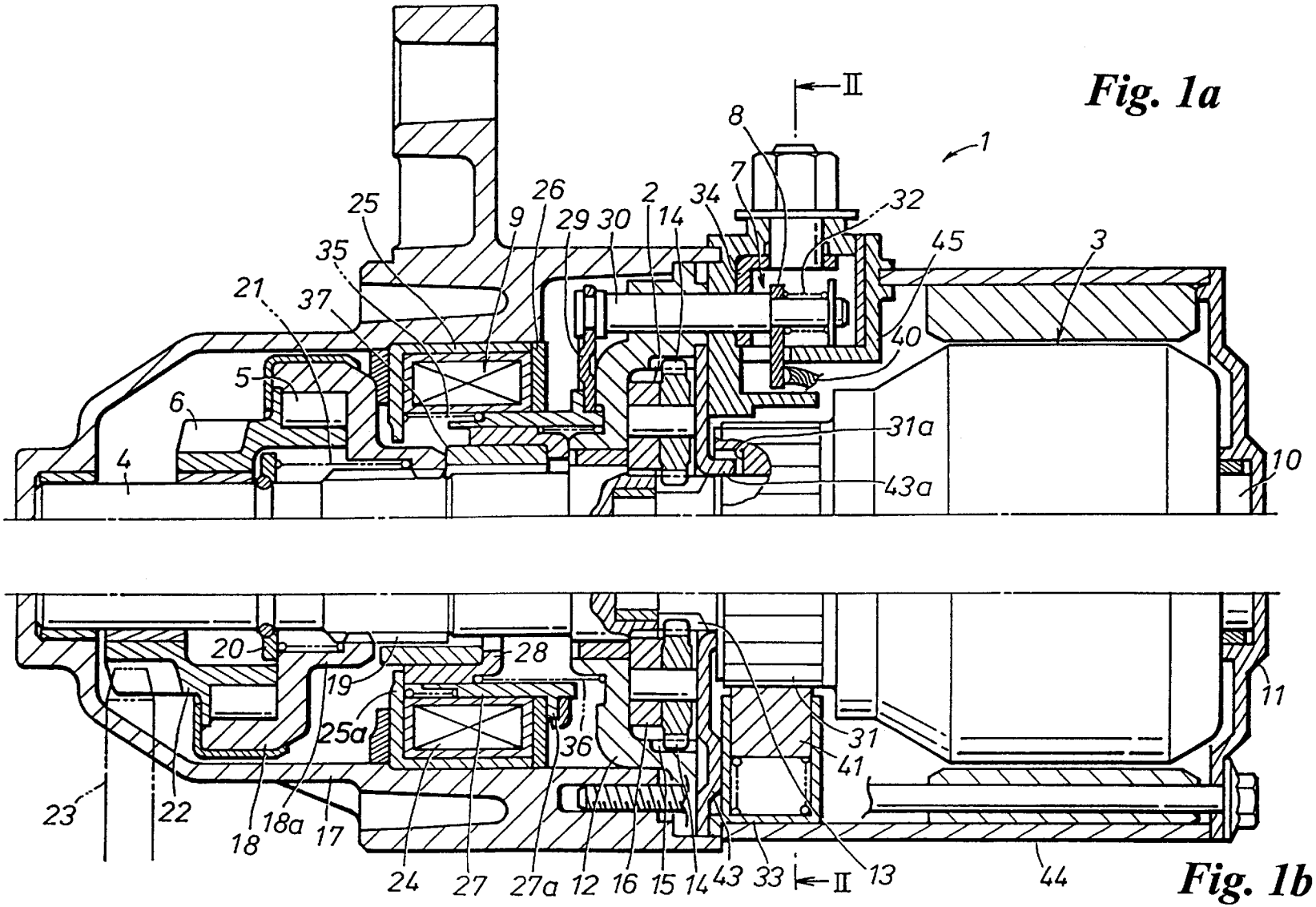
FIG. 1*b* is a bottom half sectional view thereof showing the operative condition of the engine starter.

FIGS. 1*a* and 1*b* generally illustrates an engine starter equipped with a reduction gear unit which is constructed according to the present invention, and the upper half of the FIG. 1*a* drawing illustrates the starter at its inoperative state while the lower half of the FIG. 1*b* drawing illustrates the starter at its operative state. This starter 1 produces a torque which is necessary for starting an internal combustion engine, and comprises an electric motor 3 equipped with a planetary gear reduction gear unit 2, an output shaft 4 connected to the electric motor 3 via the reduction gear unit 2, a one-way roller clutch 5 and a pinion 6 which are slidably mounted on the output shaft 4, a switch unit 7 for selectively opening and closing the electric power line leading to the electric motor 3, and a solenoid device 9 for axially moving a moveable contact 8 of the switch unit 7 as well as the pinion 6.

The electric motor 3 consists of a known commutator type DC electric motor, and its rotor shaft 10 is pivotally supported in a central recess of a bottom plate 11 at its right end, and pivotally supported in a central recess provided in a right end surface of the output shaft 4, which is coaxially disposed with respect to the rotor shaft 10, at its left end. The bottom plate 11 closes a right end of a cylindrical motor casing 44.

The reduction gear unit 2 is provided in a recess defined on the inner surface of the top plate 12 of the electric motor 3 which closes the left end of the motor casing 44. The top plate 12 may consist of synthetic resin material. The reduction gear unit 2 comprises a sun gear 13 which is formed in a part of the rotor shaft 10 adjacent to the output shaft 4, a plurality of planetary gears 14 meshing with the sun gear 13, and an internal teeth ring gear 15 formed along the outer periphery of the recess defined on the inner surface of the top plate 12 to mesh with the planetary gears 14. A support plate 16 supporting the planetary gears 14 is attached, by press fitting, to the right end of the output shaft 4 which is pivotally supported in a central opening of the top plate 12.

To the top plate 12 is attached a pinion housing 17 which also serves as a securing bracket for mounting the starter to the engine. The left end of the output shaft 4 is pivotally supported in a central recess defined on the inner surface of the left wall of the pinion housing 17.

The outer circumferential surface of a middle part of the output shaft 4 engages the inner circumferential surface of a clutch outer member 18 of the one-way roller clutch 5 via a helical spline 19. The clutch outer member 18 is normally urged to the right by a return spring 21 interposed between an annular shoulder defined in a cylindrical sleeve 18*a* extending from the clutch outer member 18 toward the electric motor 3 and a stopper plate 20 secured to a left end portion of the output shaft 4. The right extreme end of the cylindrical sleeve 18*a* engages with the helical spline 19 formed in the output shaft. The return spring 21 is received in an annular gap defined between the inner circumferential surface of the sleeve 18*a* extending from the clutch outer member 18 and the outer circumferential surface of the output shaft 4. By so doing, the return spring 21 is disposed inside the one-way roller clutch 5, and the axial dimension of the assembly can be minimized.

The clutch outer member 18 engages a clutch inner member 22 of the one-way roller clutch 5 in an axially fast but rotationally free relationship (which depends on the direction of relative rotation). The outer circumferential surface of the left end of the clutch inner member 22 is integrally formed with the aforementioned pinion 6 which meshes with the ring gear 23 of the engine to drive the same. The clutch inner member 22 integrally formed with the pinion 6 is fitted on the left end of the output shaft 4 in a both rotationally and axially free relationship.

In an intermediate part of the pinion housing 17 is secured an energization coil 24 which surrounds the output shaft 4 made of non-magnetic material such as stainless steel. The energization coil 24 is surrounded by a yoke defined by a cup-shaped holder 25 having an internal flange 25*a* surrounding the output shaft 4 and an annular disk 26. In a gap defined between the inner circumferential surface of the energization coil 24 and the outer circumferential surface of the output shaft 4 is disposed an armature outer member 27 and an armature inner member 28, both made of ferromagnetic material, in a mutually coaxially nested and axially slidable relationship. The left ends of the armature members 27 and 28 oppose the axially inner surface of a central part of the internal flange 25*a* of the holder 25, and the central part of the internal flange 25*a* serves as a magnetic pole for the armature members 27 and 28. By thus making the output shaft 4 received in the solenoid device 9 from non-magnetic material, the magnetic path is concentrated in the armature and the air gap between the armature and the output shaft can be virtually eliminated so that the radial dimension of the solenoid device 9 can be minimized.

The first part of the armature or the armature outer member 27 is connected at its right end to a connecting plate 29, and, via a connecting rod 30 passing through the top plate 12 of the electric motor 3, to the moveable contact 8 of the switch unit 7 placed adjacent the commutator 31 of the electric motor 3. The moveable contact 8 is mounted to the connecting rod 30 in an axially moveable manner, and is supported by a coil spring 32 in a floating relationship so as to be selectively engaged to and disengaged from a fixed contact 34 of the switch unit 7 which is fixedly secured to a brush stay 33 provided around the commutator 31. In other words, the moveable contact 8 is linked to the armature outer member 27 via a lost motion mechanism. The armature outer member 27 is always urged to the right by a return spring 35 interposed between the armature outer member 27 and the internal flange 25*a* provided in the holder 25 of the energization coil 24, but is normally at its neutral or rest position separating the moveable and fixed contacts 8 and 34 from each other.

The second part of the armature or the armature inner member 28 is always urged to the left with respect to the top plate 12 by a coil spring 36 which is weaker that the return spring 21 of the clutch outer member 18. The armature inner member 28 is connected to a shifter member 37 made of non-magnetic material, such as synthetic resin material, having a left end engaging the right end of the clutch inner member 22.

By thus separating the armature into the armature outer member 27 for driving the moveable contact 8 and the armature inner member 28 for driving the pinion 6 which are allowed to move individually, no space is needed in axially front and rear portions of the energization coil 24, and the axial dimension of the solenoid device can be minimized.

A gap is defined between the opposing end surfaces of the clutch outer member 18 and the shifter member 37 so as to prevent them from contacting each other when the pinion 6 is fully meshed with the ring gear 23. This gap is preferably no more than one half the meshing overlap between the pinion 6 and the ring gear 23.

Figure 2:
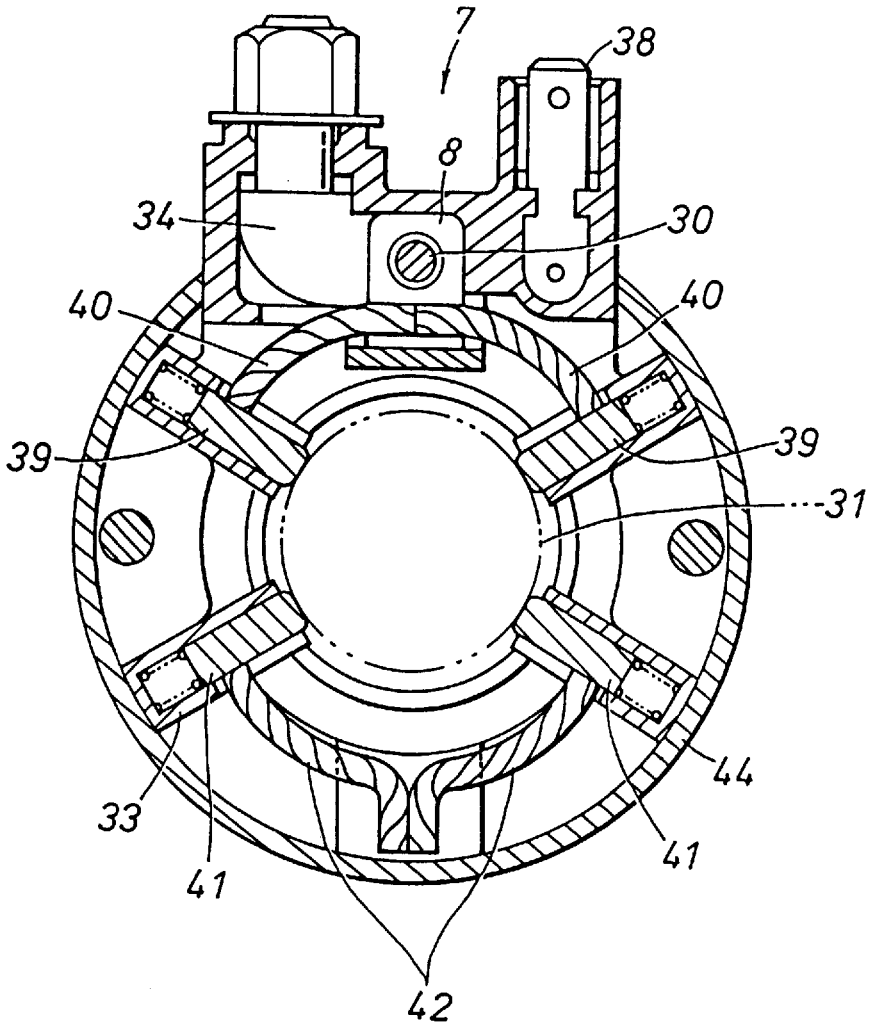
FIG. 2 is a sectional view taken along line II—II of FIGS. 1*a* and 1*b;*

The energization coil 24 is electrically connected to an ignition switch not shown in the drawing via a connector 38 *see FIG. 2) provided in the switch unit 7.

The fixed contact 34 of the switch unit 7 is electrically connected to the positive terminal of a battery not shown in the drawings, and a pair of pigtails 40 connected to a pair of positive pole brushes 39 are attached to the fixed contact 34 by spot welding also as illustrated in FIG. 2. A pair of negative pole brushes 41 are provided in a line-symmetrically opposing positions with respect to the positive pole brushes 39. The pigtails 42 for these negative pole brushes 41 are connected to a center plate 43 which is described hereinafter, and is connected to the negative terminal of the battery via the pinion housing 17 and the vehicle body which is not shown in the drawings. The switch unit 7 is provided in a space flanked by the positive pole brushes 39. By so doing, the connecting terminals leading to the battery and the pigtails 40 of the positive brushes 39 can be selectively connected by the single moveable contact 8 and the single fixed contact 34 so that the number of component parts for the switch unit 7 can be reduced, and the dimensions in both radial and axial directions can be reduced. The brushes 39 and 41 are supported in a known manner by a brush stay 33 which is made of electrically insulating material.

An annular metallic center plate 43 is interposed between the brush stay 33 and the top plate 12 to separate the reduction gear unit 2 from the electric motor 3. A central part of the center plate 43 is provided with a cylindrical portion 43*a* which projects toward the commutator 31 with its inner circumferential surface receiving the outer circumferential surface of the rotor shaft 10 defining a small gap therebetween. The free end of the cylindrical portion 43*a* is received in a recess 31*a* formed in an axial end surface of the commutator 31 to prevent grease from leaking out of the reduction gear unit 2 to the commutator 31.

The switch unit 7 is located at a top part of the starter 1, and the contacts, or the fixed contact 34 secured to the brush stay 33 and the moveable contact 8, are covered by the brush stay 33 and a switch cover 45 to prevent any particulate forcing matters that may be produced from the brushes from getting into the switch unit 7.

Now the operation of the above described embodiment is described in the following. In the inoperative condiction, because no electric current is supplied to the energization coil 24, the armature outer member 27 is at its rightmost condition under the spring force of the return spring 35, and the moveable contact 8 which is connected to the armature outer member 27 is spaced from the fixed contact 34. At the same time, the clutch outer member 18 which is urged by the return spring 21 is at its rightmost position along with the clutch inner member 22 which is integral with the pinion 6, the shifter member 37 and the armature inner member 28 with the result that the pinion 6 is disengaged from the ring gear 23.

When the ignition switch is turned to the engine start position, electric current is supplied to the energization coil 24 to magnetize the same. As a result, a magnetic path for conducing a magnetic flux is established in the armature inner and outer members 27 and 28 thereby moving the armature inner and outer members 27 and 28 to the left. The armature outer member 27, as it is closer to the central part (pole) of the internal flange 25*a* of the holder 25 than the armature inner member 28, moves before the armature inner member 28 does. As a result, the moveable contact 8 is moved to the left by the armature outer member 27 via the connecting plate 29 and the connecting rod 30, and comes into contact with the fixed contact 34. This in turn causes the electric power of the battery to be supplied to the electric motor 3, and the rotor shaft 10 to be turned. Because the moveable contact 8 comes into contact with the fixed contact 34 before the armature outer member 27 moves its full stroke, and the moveable contact 8 is mounted on the connecting rod 30 in an axially floating relationship, the pressure of the coil spring 32 is applied between the two contacts 8 and 34. At this point, the armature outer member 27 comes to a stop with a certain gap defined between the left end surface of the armature outer member 27 and the central part of the internal flange 25*a* because of the presence of a stopper integrally formed at the right end of the armature outer member 27 as an external flange 27*a* comes into contact with the annular disk 26.

As the rotor shaft 10 turns, this rotation is reduced in speed by the reduction gear unit 2, and is transmitted to the output shaft 4. Because of the inertial of the clutch outer member 18 which engages with the output shaft 4 via the helical spline 19, the axial force owing to the helical spline 19 is applied to the clutch outer member 18, causing it to move to the left. At the same time, the armature inner member 28, which is subjected to the leftward attractive force by the energization coil 24 and the pressure from the coil spring 36, starts moving to the left. This force is applied to the clutch outer member 18 as an axial force via the shifter member 37. In this case, it is preferable for the electric motor to start turning before the armature inner member 28 or the shifter member 37 comes into contact with the clutch inner mdmber 28 in view of reducing the required output of the energization coil 24. However, it is within the purview of the present invention to appropriately and freely otherwise select the timing of the start of the rotation of the electric 3 and the subsequent actuation of the helical spline 19 in relation with the axial engagement between the shifter member 37 and the clutch inner member 28 depending on the output available from the energization coil 24, and the particular condition of the engine starter.

This axial force pushes the clutch outer member 18 leftward against the biasing force of the return spring 21, and the pinion 6, which is integral with the clutch inner member 22 and is therefore integrally engaged with the clutch outer member 18, is also pushed leftward. Once the clutch outer member 18 engages with the stopper plate 20, and the pinion 6 comes into full mesh with the ring gear 23, the rotation of the output shaft 4 is transmitted to the ring gear 23, and starts the engine. At this point, the left end surface of the armature inner member 28 engages the central part of the internal flange 25*a* of the holder 25, and a small gap is defined between the left end surface of the shifter member 37 which has integrally moved with the armature inner member 28 and the clutch outer member 18. Because the armature inner member 28 receives a maximum attractive force of the energization coil 24 as it engages the central part of the internal flange 25*a* of the holder 25, even when the pinion 6 is subjected to a force which tends to disengage it from the ring gear 23, the rightward movement of the clutch outer member 18 is prevented by the shifter member 37, and the pinion 6 is prevented from dislodging from the ring gear 23.

The electric current that is required to keep the armature inner and outer members 27 and 28 stationary after they have moved the full stroke is substantially smaller than that required for starting the movement of the armature inner and outer members 27 and 28. In other words, by making use of the axial force owing to the helical spline 19 for starting the movement of the one-way roller clutch 5 including the pinion 6, the output requirement of the energization coil 24 can be reduced, and the size of the energization coil 24 can be accordingly reduced.

A gap is defined between the opposing end surfaces of the clutch outer member 18 and the shifter member 37, and this gap minimizes the time of contact between the clutch outer member 18 and the shifter member 37 so as to minimize the friction between them and hence the wear of the associated parts. Because this gap is sufficiently smaller than the meshing overlap between the pinion 6 and the ring gear 23 (for instance, no more than one half the overlap), any premature disengagement between them can be avoided.

Once the engine has started and the rotational speed of the engine exceeds that of the pinion 6, the pinion 6 will start turning freely by virtue of the one-way roller clutch 5 in the same manner as in the conventional engine starter.

When the supply of electric current to the energization coil 24 ceases, owing to the biasing force of the return spring 21 acting upon the clutch outer member 18 and the biasing force of the return spring 34 acting upon the armature outer member 27, the pinion 6 is disengaged from the ring gear 23 and the moveable contact 8 is separated from the fixed contact 32, thereby stopping the electric motor 3.

Figure 3A:
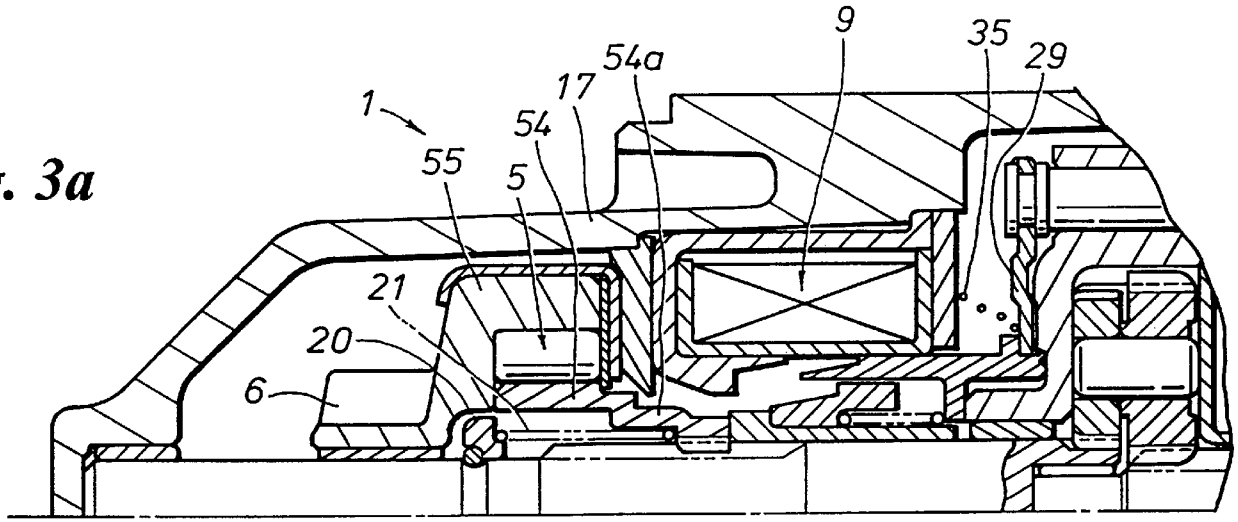
FIGS. 3*a* and 3*b* is a view similar to FIGS. 1*a* and 1*b* showing a second embodiment of the present invention.
Figure 3B:
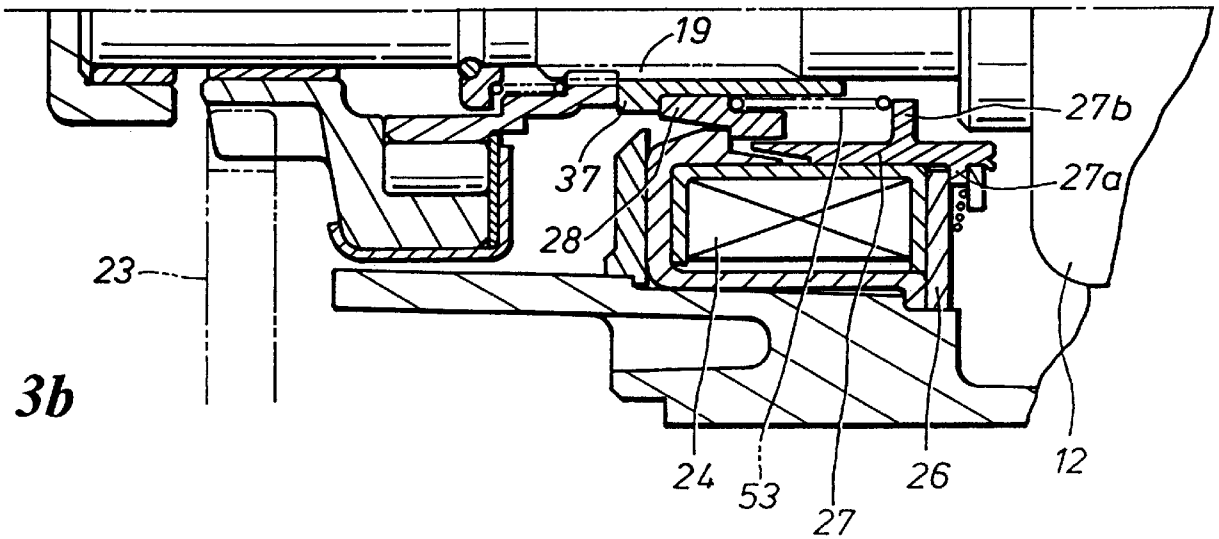
Figure 3C:
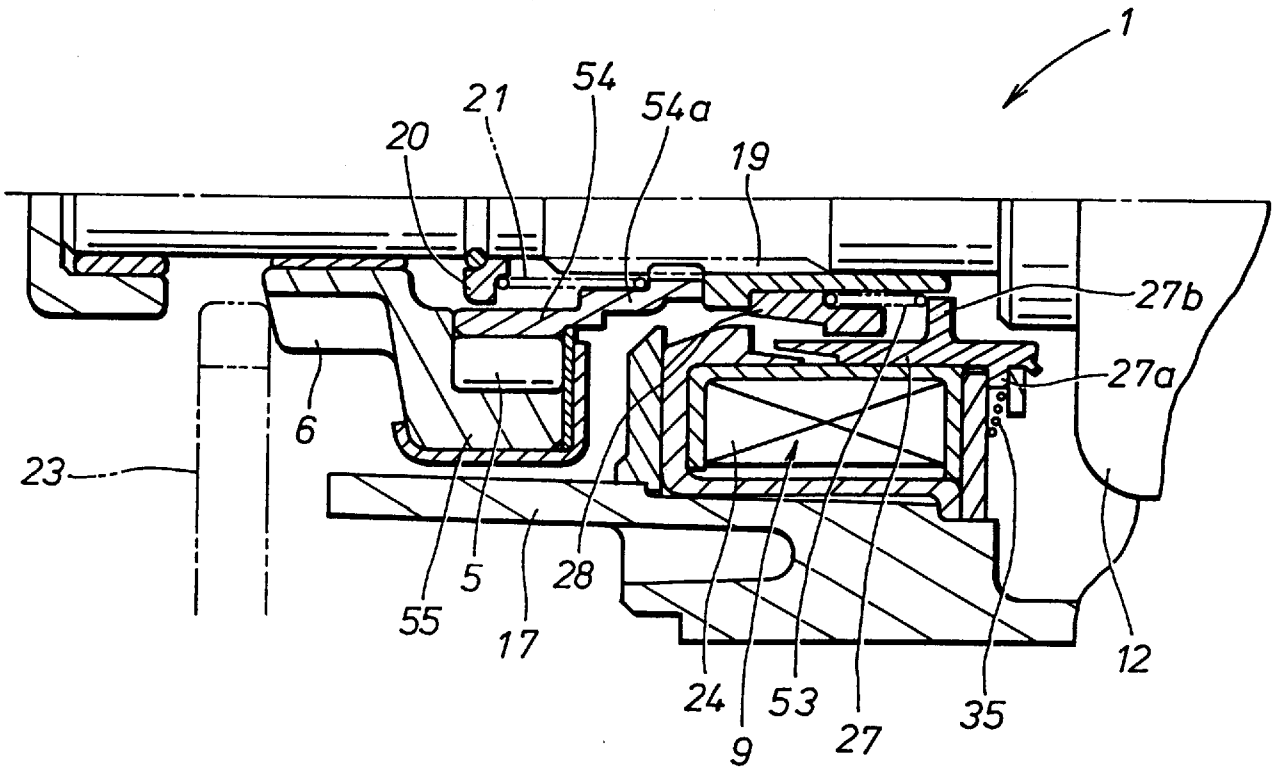
FIG. 3*c* is a section view similar to FIG. 3*b*, however, showing an intermediate state of the starter when a front end of the pinion has abutted a side surface of the ring gear or when the pinion is about to mesh with the ring gear.

FIGS. 3*a* and 3*b* and detail 3*c* show a second embodiment of the present invention, and the parts corresponding to those of the first embodiment are denoted with like numerals. In this embodiment, the armature outer member 27 is provided with an internal flange 27*b*. A compression coil spring 53 is interposed between an annular shoulder defined by this internal flange 27*b* and an annular shoulder defined in the armature inner member 28. Further, in this embodiment, the clutch inner member 54 of the one-way roller clutch 5 is provided with an extension consisting of a sleeve 54*a* which engages the helical spline 19, and the pinion 6 is integrally formed with the clutch outer member 55. The shifter member 37 in this case is adapted to actuate the clutch inner member 54 via the sleeve 54*a*. A conical compression coil spring 35 is interposed between the connecting plate 29 and the opposing end surface of the annular disk 26 to positively return the inner solenoid member 27 to its rest position.

The upper half of FIG. 3*a* shows the engine starter at its rest condition. When the ignition key is turned to the engine start position, and the solenoid device 9 is energized, the outer armature member 27 is moved leftward until its external flange 27*a* abuts the opposing annular disk 26. By this time, the electric motor 2 is actuated by the closure of the switch unit 7, and the armature inner member 28 is also moved leftward. As a result, the pinion 6 is actuated leftward, and can either mesh with the ring gear 23 or abuts the side surface of the ring gear 23 as illustrated in FIG. 3*b* and detail 3*c*. However, by this time, the armature outer member 27 has narrowed the magnetic gap to such an extend the armature inner member 28 is moved leftward with a powerful magnetic drive force. This force is assisted by the direct and/or resilient engagement between the armature inner member 28 and the armature outer member 27. Therefore, the solenoid device 9 ensures the pinion to be meshed with the ring gear 23 without fail under all possible conditions. The lower half of FIG. 3*a* shows the engine starter when the pinion 6 has been fully pushed out by the solenoid device 9. Normally, the pinion 6 is further pushed out by its own inertial and/or by the force of the helical drive until an annular shoulder defined in the inner bore of the clutch inner member 54 abuts the stop ring 20, and the pinion 6 is fully meshed with the ring gear 23. Thus, similar to the first embodiment, a slight gap exits between the forward end of the shifter member 37 and the opposing annular end surface of the clutch inner member 54 when the pinion 6 is fully meshed with the ring gear 23.

According to this embodiment, because the movement of the second part of the armature or the armature inner member 28 is not only magnetically assisted (by reducing the magnetic gap effective for actuating the armature inner member 28) but also mechanically assisted (by the resiliency of the compression coil spring 53 and/or by mutual abutting of the internal flange 27*b* and the opposing annular shoulder of the armature inner member 28) by the first part of the armature or the armature outer member 27. According to this structure, the reliability of the operation of the second part of the armature can be ensured. Also, because the action of the helical drive is favorably assisted by the solenoid device, the engine starter can reliably start the engine.

In this embodiment, the pinion 6 is integral with the clutch outer member 55 of the one-way roller clutch 5, and the extension 54*a* meshing with the helical spring 19 is integral with the clutch inner member 64. In other words, the clutch outer and inner members are reversed from those of the first embodiment. According to this arrangement, even when these members are made of magnetic material, the magnetic flux of the solenoid device is less directed to these members, and the loss of the efficiency of the solenoid device can be reduced.

Figure 4A:
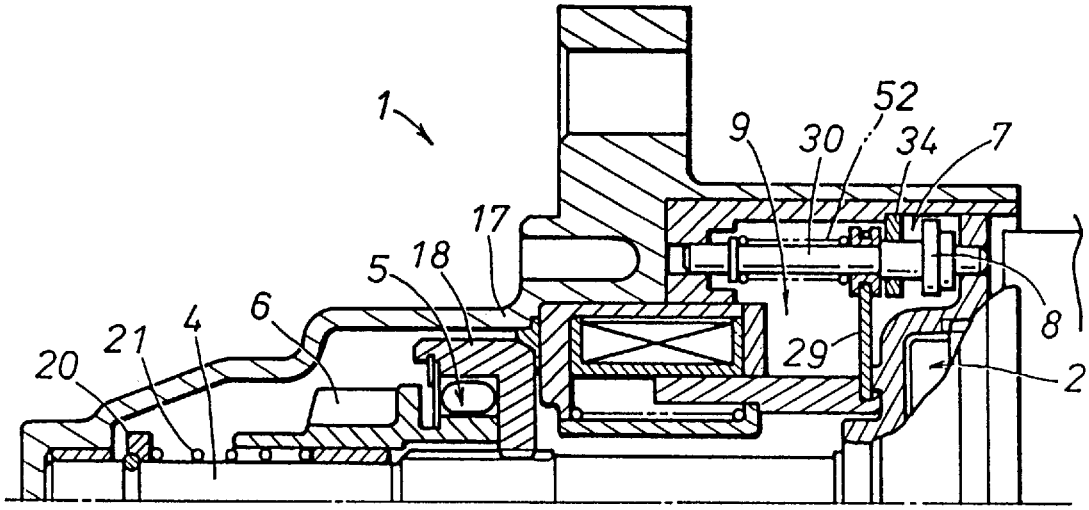
FIGS. 4*a* and 4*b* are views similar to FIGS. 1*a* and 1*b* showing a third embodiment of the present invention.
Figure 4B:
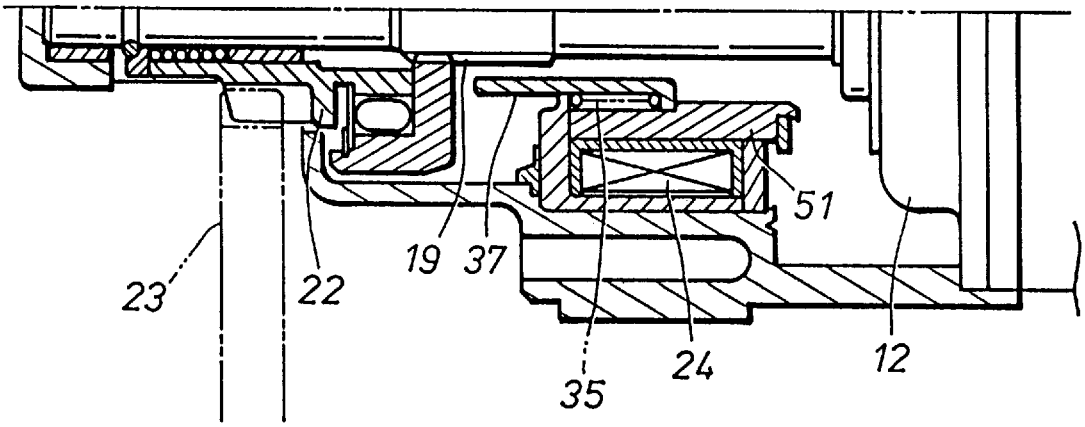

The armature consisted of two coaxially nested separate parts in the above described embodiments, but it is also possible to drive the pinion 6, including the one-way roller clutch 5, and the moveable contact 8 with a single armature member 51 as illustrated in FIGS. 4*a* and 4*b* in which the parts corresponding to those of the first and second embodiments are denoted with like numerals without repeating the detailed description of these parts.

In this embodiment, to the right end of the armature member 51 is connected a connecting plate 29 which is in turn connected to a connecting rod 30 carrying the moveable contact 8. The left end of the armature member 51 is connected to a shifter member 37 which can engage the clutch outer member 18.

The connecting plate 29 and the connecting rod 30 are connected with each other via a coil spring 52, and the axial force acting upon the armature member 51 upon energization of the energization coil 24 is transmitted to the connecting rod 30 via the connecting plate 29 and the coil spring 52.

In this case, upon energiziang the energization coil 24, the armature member 51 is attracted by the energization coil 24 leftward so that the connecting plate 29 is moved to the left. As a result, the coil spring 52 pushes the connecting rod 30 leftward until the moveable contact 8 comes into contact with the fixed contact 34. The gap between the fixed contact 34 and the moveable contact 8 in the rest condition is selected to be smaller than the gap between the shifter member 37 and the clutch outer member 18 so that the contact between the fixed contact 34 and the moveable contact 8 may occur before that between the shifter member 37 and the clutch outer member 18. Once the fixed contact 34 and the moveable contact 8 are brought into contact with each other, the coil spring 52 is compressed, and only the connecting plate 29 continues to move with the armature member 51 without regard to the movement of the connecting rod 30.

Once the contacts are closed, and the electric motor has started turning by virtue of the electric power supplied from the battery, the axial force acting upon the clutch outer member 18 connected to the rotor shift 10 via the helical spline 19 forces the pinion 6 leftward into meshing engagement with the ring gear 23, and is assisted by the axial force acting upon the armature member 51 in the same manner as the first emmbodiment. Therefore, the armature member 51 is only required to retain the pinion 6 and the ring gear 23 in meshing engagement, and is therefore not required to have so much an output power as would be otherwise required.

Thus, according to the present invention, because the pinion can be axially pushed out by making use of the rotation of the electric motor, even though the pinion is directly driven by the armature of the solenoid device, the output of the energization coil may be relatively small. Therefore, the present invention can make a significant contribution in reducing the size of the engine starter.

Although the present invention has been described in terms of specific embodiments thereof, it is possible to modify and alter details thereof without departing from the spirit of the present invention.

What we claim is:

1. An engine starter, comprising:

an electric motor;

an output shaft disposed coaxially with respect to said electric motor in a power transmitting relationship;

a one-way clutch assembly including an integral pinion for driving a ring gear of an engine, and including a one-way clutch having one end integrally coupled to said pinion and another end coupled to an output end of said output shaft via a helical spline, said pinion and said one-way clutch being disposed in a coaxial relationship with respect to said output shaft;

a solenoid device comprising an annular armature and an annular energization coil surrounding said output shaft to axially drive said one-way clutch assembly;

a switch unit disposed on a side of said solenoid device facing away form said one-way clutch assembly, and including a fixed contact and a moveable contact for selectively closing a power supply line leading to said electric motor; and a connecting member extending between said armature and said moveable contact.

2. An engine starter according to claim 1, further comprising a floating spring interposed in a path of force transmission between said armature and said moveable contact of said switch unit for allowing movement of said armature after said moveable contact has come into contact with said fixed contact.

3. An engine starter according to claim 2, wherein a first gap is defined in an axial force transmitting path between said pinion and said armature, said first gap being no less than a stroke of said moveable contact from a rest position thereof to a contact position thereof for establishing a contact with said fixed contact.

4. An engine starter according to claim 3, wherein a second gap is defined in an axial force transmitting path between said pinion and said armature, said second gap being less than one half of a meshing overlap between said pinion and said ring gear when said pinion is properly meshed with said ring gear.

5. An engine starter according to claim 1, wherein said output shaft is made of non-magnetic material.

6. An engine starter according to claim 1, wherein said armature comprises a first part which is connected to said moveable contact and a second part which is connected to said pinion, said first and second armature parts being coaxially nested with each other so as to be axially moveable relative to each other.

7. An engine starter according to claim 6, wherein said first part of said armature is coaxially received in said second part of said armature, and said first armature part is provided with a stopper which stops said first armature part upon energization of said energization coil at a position leaving a small magnetic air gap which is filled by said second part of said armature.

8. An engine starter according to claim 7, further comprising engagement means provided between said first and second parts of said armature to transmit an axial force from said first armature part to said second armature part to assist movement of said second armature part toward closing said magnetic air gap.

9. An engine starter according to claim 8, wherein said engagement means comprises axial shoulders defined on said first and second armature parts which shoulders abut each other when said first armature part is actuated into an axial movement by said energization coil.

10. An engine starter according to claim 8, wherein said engagement means comprises spring means interposed between said first and second armature parts for transmitting an axial force from said first armature part to said second armature part.

11. An engine starter according to claim 6, wherein a first end of the connecting member is attached to said first armature part and another end of the connecting member is attached to said moveable contact.

12. An engine starter according to claim 11 in which the connecting member and moveable contact are axially moveable.

13. An engine starter according to claim 1, further including a pinion housing and a motor housing connected to the pinion housing, and wherein said output shaft is journalled in said pinion housing, said one-way clutch assembly is in said pinion housing, said solenoid is in said pinion housing, said switch unit is in said motor housing, and wherein said connecting member extends from within said pinion housing to within said motor housing for attachment to said moveable contact.

14. An engine starter, comprising:

an electric motor;

an output shaft disposed coaxially with respect to said electric motor in a power transmitting relationship;

a pinion for driving a ring gear of an engine coupled to said output shaft via a helical spline in a coaxial relationship;

a switch unit including a fixed contact and a moveable contact for selectively closing a power supply line leading to said electric motor; and a solenoid device comprising an annular armature and an annular energization coil surrounding said output shaft to axially drive said pinion and the moveable contact of said switch unit in an axial direction, said armature comprising an armature outer member and an armature inner member, the armature members being coaxially nested with each other and being axially slidable relative to each other, the armature members being disposed in a gap defined between an inner circumferential surface of said energization coil and an outer surface of said output shaft, one of said armature members being connected to said pinion via said helical spline and the other of said armature members being connected to said moveable contact.

15. An engine starter according to claim 14 further including a clutch member and wherein said armature outer member is connected to said moveable contact and said armature inner member is connected to said pinion via the clutch member.

16. An engine starter according to claim 14 further including an axially moveable connecting member fixedly extends between the other of said armature members and said moveable contact.

17. An engine starter according to claim 14 wherein said armature members are made of ferromagnetic material and wherein said output shaft within said energization coil is made of non-magnetic material such that a magnetic path formed by said energization coil is concentrated in said armature.

* * * * *